US005900599A

United States Patent [19]

Ohashi et al.

[11] Patent Number: 5,900,599

[45] Date of Patent: May 4, 1999

[54] SWITCH FOR DISPLAY

[75] Inventors: Shigeo Ohashi; Nobuo Misaki; Tatsuya Minagawa; Toyonaru Tanaka, all of Kawasaki, Japan

[73] Assignee: Nihon Kaiheiki Industrial Company, Ltd., Japan

[21] Appl. No.: 08/879,809

[22] Filed: Jun. 20, 1997

[51] Int. Cl.[6] ..... H01H 13/70

[52] U.S. Cl. ..... 200/5 A; 200/310; 200/314; 200/317

[58] Field of Search ..... 200/5 A, 308–317; 341/16, 22, 23; 400/472, 490, 491, 491.2, 493, 495, 495.1

[56] References Cited

U.S. PATENT DOCUMENTS

| | | | |
|---|---|---|---|
| 4,288,672 | 9/1981 | Puccini | 200/314 |
| 4,326,195 | 4/1982 | Seki et al. | 340/365 R |
| 5,193,669 | 3/1993 | Demeo et al. | 200/512 |
| 5,384,459 | 1/1995 | Patino et al. | 250/229 |
| 5,515,045 | 5/1996 | Tak | 341/23 |
| 5,605,406 | 2/1997 | Bowen | 400/472 |
| 5,694,124 | 12/1997 | Wood | 341/22 |
| 5,697,493 | 12/1997 | Sach et al. | 200/314 |

*Primary Examiner*—Michael A. Friedhofer
*Attorney, Agent, or Firm*—Lorusso & Loud

[57] ABSTRACT

A display switch includes switch elements disposed on a display which is capable of electrically changing images displayed thereon. Above the switch elements are disposed a plurality of buttons formed of a transparent material and supported by a frame member. A depression is formed in each of at least two opposite side surfaces of each button, and the frame member has flange portions that engage with the depressions in order to limit movement of the buttons. Also, elastic members are disposed under the buttons in order to allow each button to move during operation while imparting a feel to a user and to automatically return the button to its original position.

9 Claims, 12 Drawing Sheets

SWITCH FOR DISPLAY

BACKGROUND OF THE INVENTION

1. Field of the Invention

The present invention relates to a switch for a display (herein after referred to as a "display switch") in which transparent buttons are disposed on the top surface of the display such that each button is depressable through a proper strokes thereby imparting a secure feel to a user upon operation.

2. Description of the Related Art

As shown in FIG. 1, a conventional display switch of the above-mentioned type includes a touch panel switch 10 disposed on the top surface of a display 1 such as a CRT or an LCD. The electrical display is arbitrarily changed through operation of the touch panel switch 10. The touch panel switch 10 is formed through superimposition of a lower transparent sheet 5 having a plurality of transparent electrodes 2 formed on its upper surface, a spacer 6, and an upper transparent sheet 9 having a plurality of transparent electrodes 7 formed on its lower surface.

In the touch panel switch 10 in order to separate the transparent electrodes 7 of the upper transparent sheet 9 from the transparent electrodes 2 of the lower transparent sheet 5, dot spacers 3 are provided on the lower transparent sheet 5, in addition to the spacer 6.

Circuit patterns 4 and 8 are respectively provided on the lower and upper transparent sheets 5 and 9. These circuit patterns 4 and 8 are led to respective tail portions of the lower and upper transparent sheets 5 and 9 and are connected to the display 1.

However, in the above-described conventional display switch, feel of depressing movement cannot be imparted to a user when he/she depresses an operation portion. The lack of feel of depressing operation makes the operation dull, so that the user feels insecurity as to whether the operation is performed properly. Also, the user may erroneously depress the switch two or more times, and may depress the switch with a force greater than required.

Recently, such a display switch has often been used in automatic teller machines and ticket vending machines. Since sight-impaired persons cannot find the position of an operation portion of the switch with their fingers, the introduction of such a display switch has caused a social problem.

SUMMARY OF THE INVENTION

In view of the foregoing problems, an object of the present invention is to provide a display switch whose operational members are distinct and which imparts a good feel to a user upon operation.

In order to achieve the above object, the present invention provides a display switch which comprises switch elements disposed on a display which is capable of electrically changing images displayed thereon. Above the switch elements are disposed a plurality of buttons formed of a transparent material and supported by a frame member A depression is formed in each of at least two opposite side surfaces of each button, and the frame member has flange portions that engage with the depressions in order to limit movement of the buttons. Also, elastic members are disposed under the buttons in order to allow each button to move during operation while imparting a feel to a user and to automatically return the button to its original position.

Specifically, the frame member having the switch elements and the buttons is disposed on the top surface of the display such as an LCD or a CRT. In order to dispose the buttons within the frame member, there are provided partition plates for dividing the interior space of the frame member.

Each switch element is composed of first and second elements. The first element is either a transparent sheet having transparent electrodes on the upper surface thereof or a flexible printed circuit board disposed under the frame member or the partition plates. The second element is an elastic curved member formed of a transparent sheet or plate having transparent electrodes. The switch element closes and opens an electric circuit in response to movement of the corresponding button.

In order to allow a user to clearly see through images on the display, the buttons are formed of a material having an excellent transparency.

Flange portions are integrally formed on the frame member and the partition plates, and a depression is formed in each of at least two opposite side surfaces of each button in order to establish depression/projection engagement with the corresponding flange portion. The frame member and the partition plates are assembled together through depression/projection engagement. During assembly, the buttons are slid along the flange portions of the frame member and the partition plates, so that the depressions and the flange portions engage with each other through depression/projection engagement. The depressions of the buttons are formed to be larger than the flange portions, so that the buttons can be moved freely.

Engagement projections for disposing elastic members are provided on the frame member or the partition plates. An elastic member formed in a strip shape and having a curved portion substantially at its center portion is disposed between the engagement projections so as to push the corresponding button upward.

In the display switch having the above-described structure, when a button is pressed, the corresponding elastic member reverses (i.e., bends in the opposite direction) and contacts the transparent sheet having transparent electrodes on the upper surface thereof or the flexible printed circuit board disposed under the frame member or the partition plates. When the button is released from the pressed state, the button returns to its original position.

The present invention also provides a display switch which is disposed on the top surface of a display capable of electrically changing images displayed thereon. In the display switch, partition plates are disposed within a substantially rectangular frame member in order to divide the inside space of the frame member into a plurality of sections. Elastic members each made of a wire material are engaged with the partition members, and movable buttons made of a transparent material are disposed such that the buttons are pushed upward by the elastic members. Moreover, on the bottom surface of a printed circuit board, light-emitting elements are disposed along two adjacent sides while light-receiving elements are disposed along the remaining two sides such that the light-emitting elements are opposed to the light-receiving elements and light paths are formed in a matrix. When one of the buttons is operated, the corresponding light paths between the light-emitting elements and the light-receiving elements are shut off.

The present invention further provides a display switch in which are disposed a decorative plate, a substantially rectangular frame member, and partition plates for dividing the inside space of the frame into a plurality of rows. In addition, elastic members each formed from a wire material and having two free ends are engaged with the partition plates, and buttons made of a transparent material are disposed in a movable manner. The number of the partition plates varies with the number of the buttons.

The frame member has depressions with which opposite ends of the partition plates are engaged. Moreover, recesses for receiving light-emitting elements and light-receiving elements are formed such that each recess is located between the corresponding depressions. On the frame member is disposed a printed circuit board having a rectangular opening substantially identical to that of the frame member. Moreover, on the bottom surface of the printed circuit board, the light-emitting elements are disposed along two adjacent sides while the light-receiving elements are disposed along the remaining two sides such that the light-emitting elements are opposed to the light-receiving elements and light paths are formed in a matrix. The light-emitting elements and the light-receiving elements are disposed on the printed circuit board via spacers.

The printed circuit board and the frame member having the above described structures are assembled together with the decorative plate through depression/projection engagement between fixation recesses formed in the side surfaces of the frame member and a plurality of downwardly extended portions of the decorative plate, thereby completing a display switch.

In the display switch having the above-described structure, when one of the buttons is operated, the corresponding light paths between the light-emitting elements and the light-receiving elements are shut off.

DESCRIPTION OF THE PREFERRED EMBODIMENTS

Embodiments of the present invention will now be described in detail with reference to the drawings.

Figure 1:
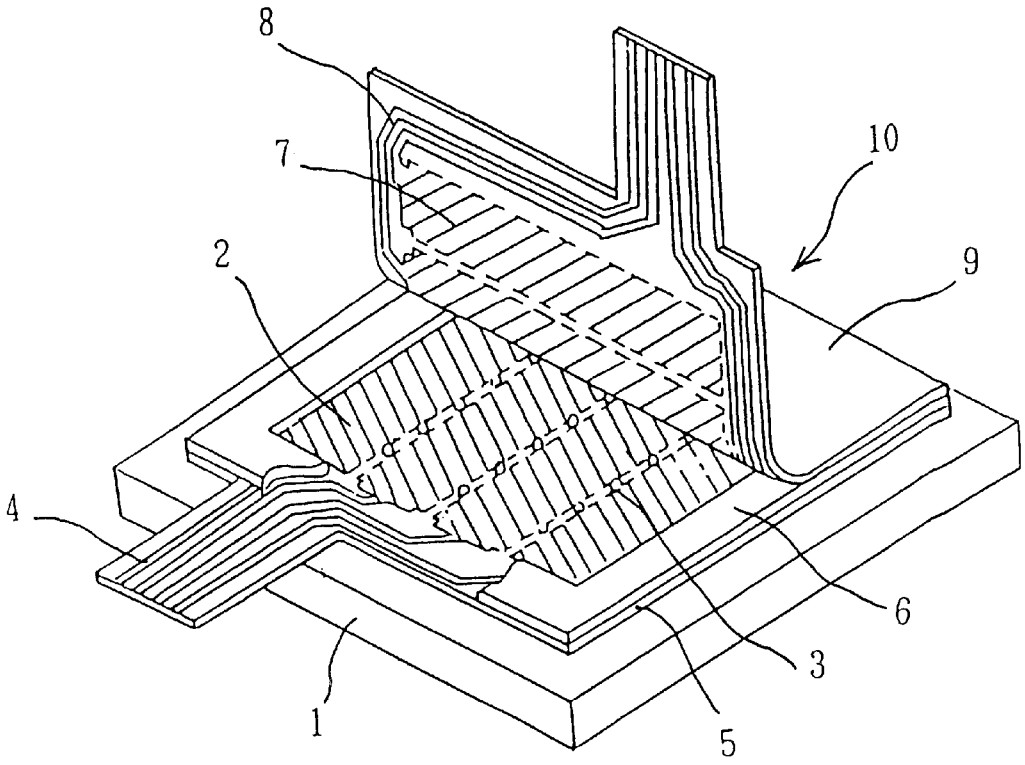
PRIOR ART FIG. 1
FIG. 1 is exploded perspective view of a main portion of conventional display switch.
Figure 2:
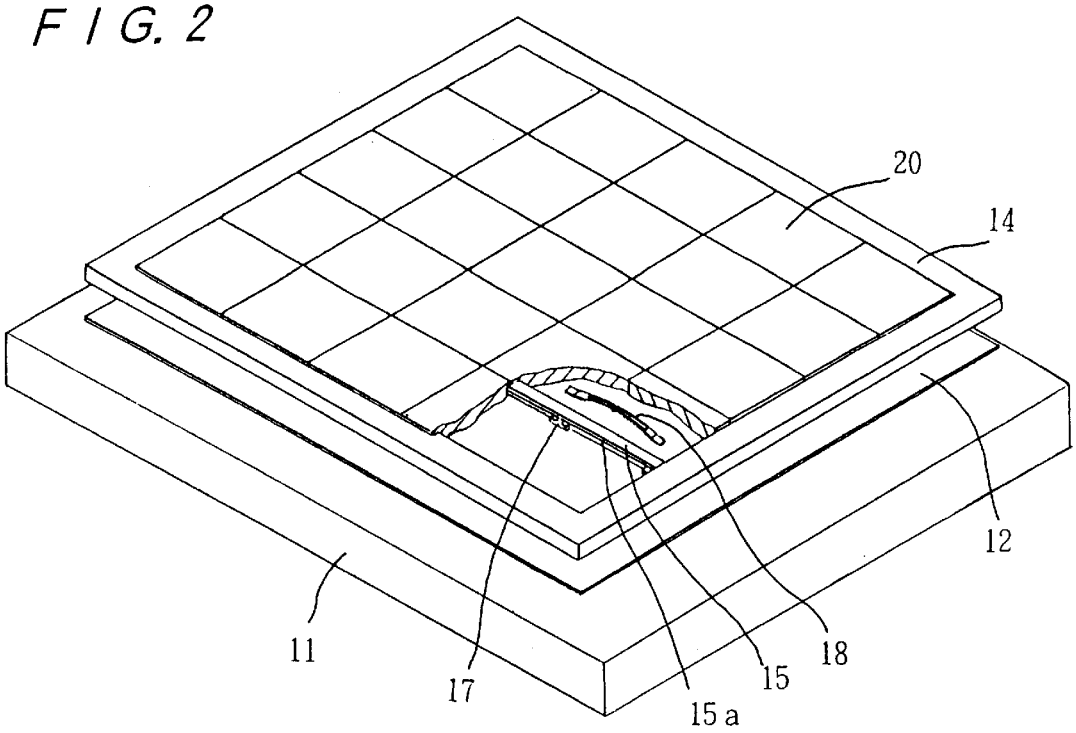
FIG. 2 is a perspective view of a main portion of a display switch according to a first embodiment of the present invention.
Figure 3:
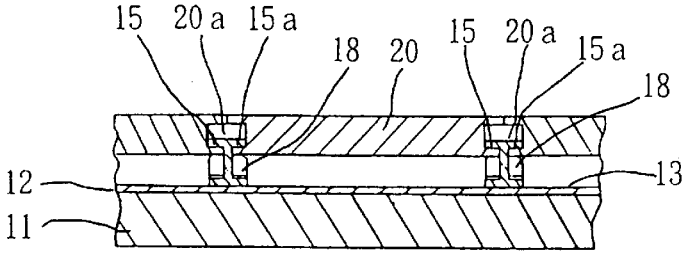
FIG. 3 is an enlarged cross-sectional view of the main portion of the display switch according to the first embodiment of the present invention.
Figure 4:
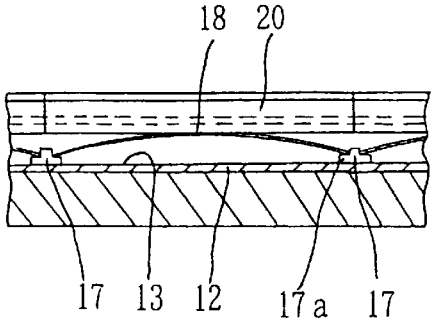
FIG. 4 is an enlarged cross-sectional view showing the toggle mechanism of the display switch according to the first embodiment of the present invention.

FIG. 2 is a perspective view of a main portion of a display switch according to a first embodiment of the present invention; FIG. 3 is an enlarged cross-sectional view of the main portion of the display switch; FIG. 4 is an enlarged cross-sectional view showing the toggle mechanism of the display switch; and FIG. 5 is an enlarged perspective view of the main portion of the display switch.

In these drawings, numeral 11 denotes a display, such as a CRT or an LCD, which electrically displays characters, symbols, and the like. A transparent sheet 12 having a transparent electrode 13 is disposed on the top surface of the display 11. On the transparent sheet 12 are disposed partition plates 15 built in a frame member 14. A plurality of buttons 20 are disposed in respective spaces formed by the frame member 14 and the partition plates 15.

Figure 5:
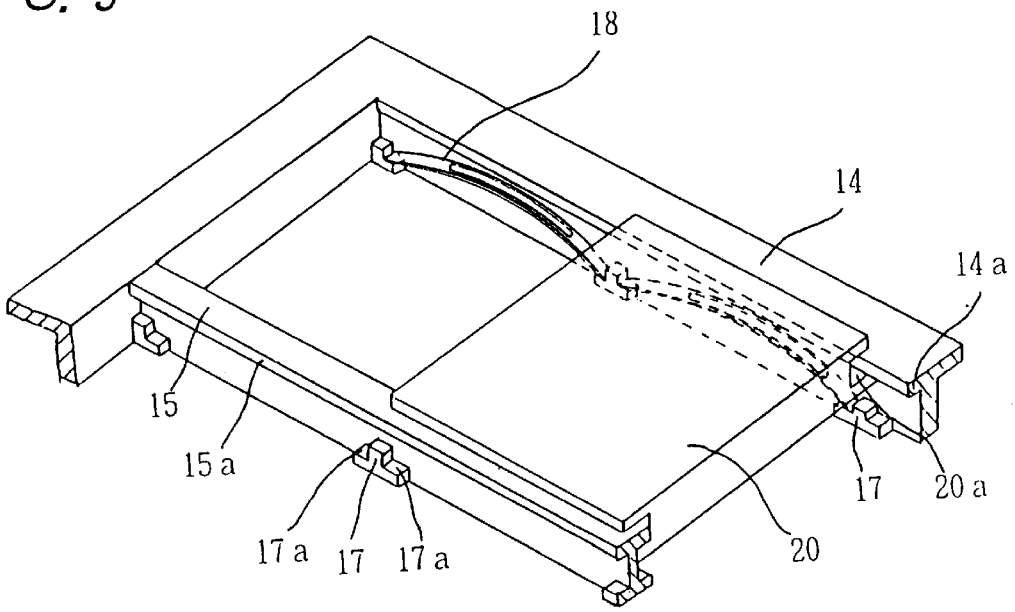
FIG. 5 is an enlarged perspective view of the main portion of the display switch according to the first embodiment of the present invention.

As shown in FIG. 5, a depression 20*a* is formed in each of at least two opposite side surfaces of each button 20, and the frame member 14 and the partition plates 15 have integrally formed flange portions 14*a* and 15*a*. These flange portions 14*a* and 15*a* are engaged with the depressions 20*a* of the buttons 20 through depression/projection engagement. Although not illustrated in the drawings, the frame member 14 and the partition plates 15 are assembled together through depression/projection engagement. During this assembly, the buttons 20 are slid into the respective spaces between the flange portions 14*a* of the frame member 14 and the flange portions 15*a* of the partition plates 15 and between the flange portions 15*a* of the partition plates 15, so that the depressions 20*a* of the buttons 20 engage with the flange portions 14*a* and 15*a*. Since the depressions 20*a* of the buttons 20 are formed to be larger than the flange portions 14*a* and 15*a* of the frame member 14 and the partition plates 15, the buttons 20 can be moved vertically in the drawings. The buttons 20 are formed of a transparent material in order to allow a user to see images on the display 11 through the buttons 20.

The frame member 14 and the partition plates 15 have engagement projections 17 that are used for disposing elastic members 18. Each of the elastic members 18 is formed in a strip-like shape such that it has a curved portion substantially at the center thereof. Each elastic member 18 is disposed between adjacent engagement projections 17 in order to push the corresponding button 20 upward. Each engagement projection 17 has stepped portions 17*a* which receive the opposite ends of the elastic member 18.

In the display switch having the above-described structure, when one of the buttons 20 is depressed, the corresponding elastic member 18 reverses and contacts the transparent electrode 13 of the transparent sheet 12. When the depressing pressure acting on the button 20 is removed, the elastic member 18 separates from the electrode 13 and returns to its original position.

Next, a second embodiment of the present invention will be described.

Figure 6:
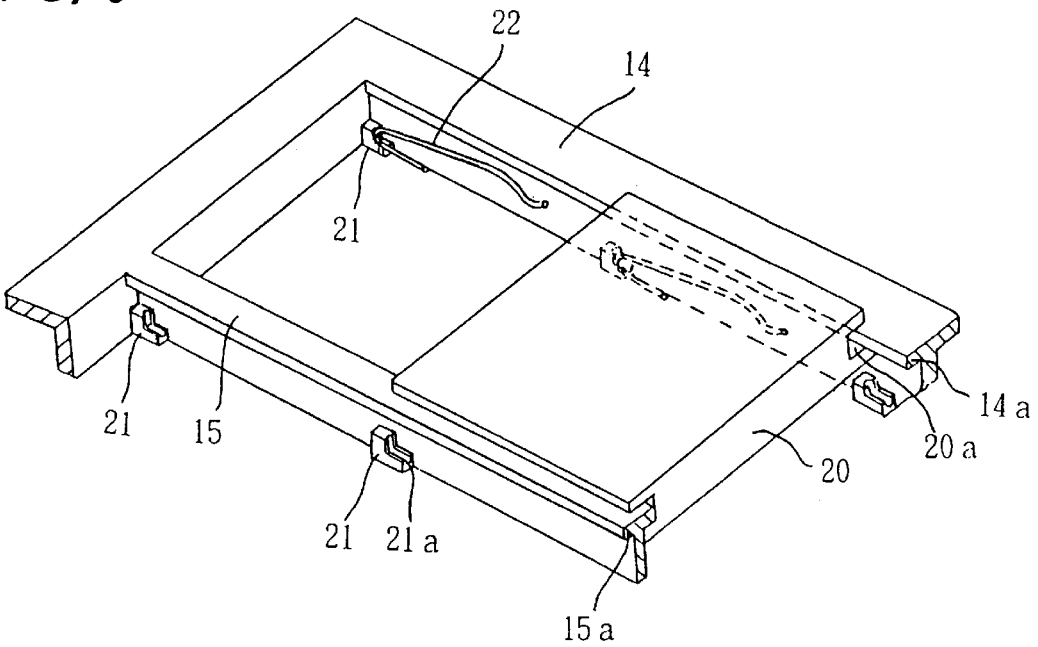
FIG. 6 is an enlarged perspective view of a main portion of a display switch according to a second embodiment of the present invention.

FIG. 6 is an enlarged perspective view of a main portion of a display switch according to the second embodiment of the present invention. Portions identical to those of the first embodiment are denoted by the same reference symbols, and descriptions therefor will be omitted.

The present embodiment is generally the same as the first embodiment. However, each of the elastic members disposed on the frame member 14 and the partition plates 15 is a wire material 22, which is bent into a U-like shape. The wire materials 22 are disposed such that the bent portions of the wire materials 22 are received by depressions 21*a* of engagement projections 21 provided on the frame member 14 and the partition plates 15. The buttons 20 are pushed upward by the wire materials 22.

In the display switch having the above-described structure, when one of the buttons 20 is depressed, the free end of the corresponding wire material 22 serving as the elastic member is lowered, so that the free end of the wire material 22 contacts the transparent electrode 13 of the transparent sheet 12. When the depressing pressure acting on the button 20 is removed, the wire material 22 serving as the elastic member separates from the electrode 13 and returns to its original position.

Next, a third embodiment of the present invention will be described.

Figure 7:
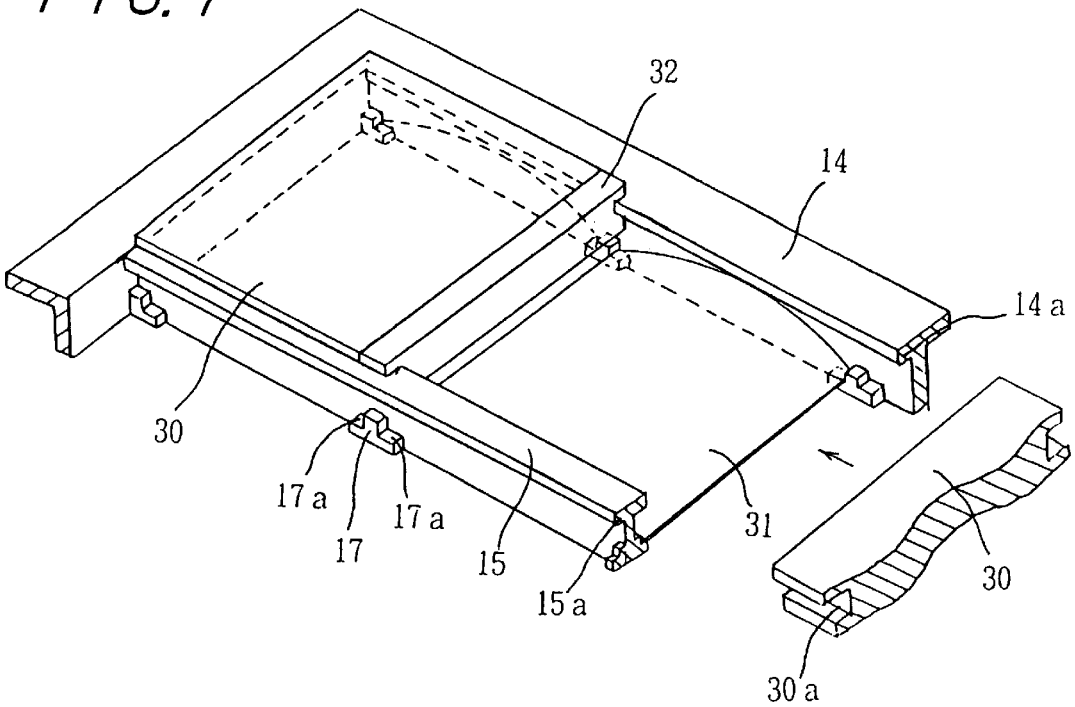
FIG. 7 is an enlarged perspective view of a main portion of a display switch according to a third embodiment of the present invention.

FIG. 7 is an enlarged perspective view of a main portion of a display switch according to the third embodiment of the present invention. The transparent sheet disposed on the top surface of the display is the same as that used in the first and second embodiments.

On the transparent sheet 12 is a frame member 14. Partition plates 15 are disposed in the inside space of the frame member 14. A plurality of buttons 30 are disposed in respective spaces formed by the frame member 14 and the partition plates 15. The buttons 30 are formed of a transparent material in order to allow a user to see images on the display through the buttons 30.

A depression 30*a* is formed in each of at least two opposite side surfaces of each button 30, and the frame member 14 and the partition plates 15 have continuously formed flange portions 14*a* and 15*a*. These flange portions 14*a* and 15*a* are engaged with the depressions 20*a* of the buttons 20 through depression/projection engagement. Although not illustrated in the drawings, the frame member 14 and the partition plates 15 are assembled together through depression/projection engagement. During this assembly, the buttons 30 are slid into the respective spaces between the flange portions 14*a* of the frame member 14 and the flange portions 15*a* of the partition plates 15 and between the flange portions 15*a* of the partition plates 15, so that the depressions 30*a* of the buttons 30 engage with the flange portions 14*a* and 15*a*.

Since the depressions 30*a* of the buttons 30 are formed to be larger than the flange portions 14*a* and 15*a* of the frame member 14 and the partition plates 15, the buttons 30 can be moved vertically in the drawings.

The frame member 14 and the partition plates 15 have engagement projections 17 having stepped portions 17*a* for disposing elastic members 31. Each of the elastic members 31 is formed of a transparent plate having the same size as that of the button 30 and has a transparent electrode. Each elastic member 31 has a curved portion substantially at the center thereof and is disposed between adjacent engagement projections 17 in order to push the corresponding button 30 upward.

In the third embodiment, in addition to the partition plates 15 for dividing the inside space of the frame member 14 in the vertical direction, partition plates 32 are disposed in order to divide the inside space of the frame member 14 in the right/left direction. In other words, the partition plates are disposed to form a grid-like pattern.

In the display switch having the above-described structure, when one of the buttons 30 is depressed, the corresponding elastic member 31, composed of a transparent plate having a transparent electrode, reverses and contacts the transparent electrode of the transparent sheet disposed on the top surface of the display. When the depressing pressure acting on the button 30 is removed, the transparent electrode of the transparent plate separates from the transparent electrode of the transparent sheet, and the button 30 returns to its original position.

Next, a fourth embodiment of the present invention will be described.

Figure 8:
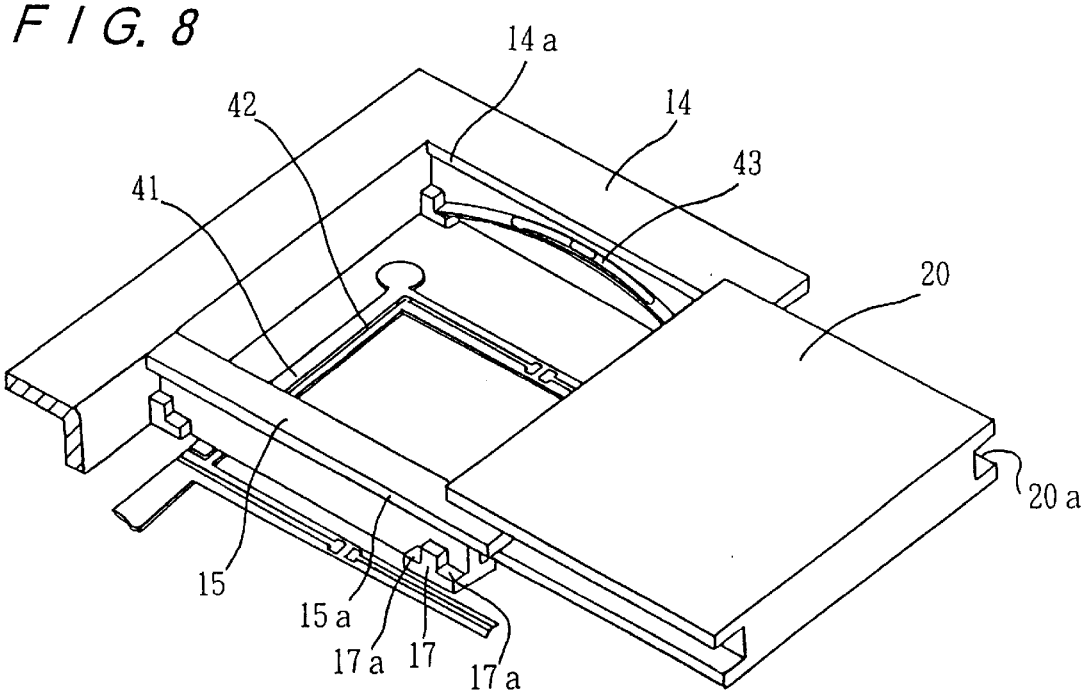
FIG. 8 is an enlarged perspective view of a main portion of a display switch according to a fourth embodiment of the present invention.
Figure 9:
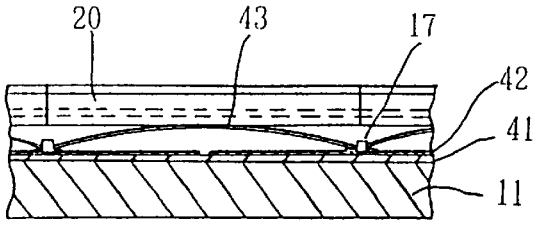
FIG. 9 is an enlarged cross-sectional view showing the contact mechanism of the display switch according to the fourth embodiment of the present invention.

FIG. 8 is an enlarged perspective view of a main portion of a display switch according to the fourth embodiment of the present invention; and FIG. 9 is an enlarged cross-sectional view showing the contact mechanism of the display switch. A flexible printed circuit board 41 is disposed on the top surface of the display. The flexible printed circuit board 41 has circuit patterns 42 whose width is the same as that of the frame member 14 or the partition plates 15.

On the flexible printed circuit board 41 is the frame member 14 and the partition plates 15 built in the frame member 14. A plurality of buttons 20 are disposed in respective spaces formed by the frame member 14 and the partition plates 15. The buttons 20 are formed of a transparent material in order to allow a user to see images on the display through the buttons 20.

A depression 20*a* is formed in each of at least two opposite side surfaces of each button 20, and the frame member 14 and the partition plates 15 have continuously formed flange portions 14*a* and 15*a*. These flange portions 14*a* and 15*a* are engaged with the depressions 20*a* of the buttons 20 through depression/projection engagement Although not illustrated in the drawings the frame member 14 and the partition plates 15 are assembled together through depression/projection engagement. During this assembly the buttons 20 are slid into the respective spaces between the flange portions 14*a* of the frame member 14 and the flange portions 15*a* of the partition plates 15 and between the flange portions 15*a* of the partition plates 15, so that the depressions 20*a* of the buttons 20 engage with the flange portions 14*a* and 15*a*.

Since the depressions 20*a* of the buttons 20 are formed to be larger than the flange portions 14*a* and 15*a* of the frame member 14 and the partition plates 15 the buttons 20 can be moved vertically in the drawings.

The frame member 14 and the partition plates 15 have engagement projections 17 provided with stepped portions 17*a* for disposing elastic members 43. Each of the elastic members 43 is formed of an electrically conductive material and has a curved portion substantially at the center thereof. Each elastic member 43 is disposed between adjacent engagement projections 17 in order to push the corresponding button 20 upward.

In the display switch having the above-described structure when one of the buttons 20 is depressed, the corresponding elastic member 43 reverses and electrically connects adjacent circuit patterns 42 of the flexible printed circuit board 41, so that an electric circuit is closed When the depressing pressure acting on the button 20 is removed, the button 20 moves upward in order to return to its original position.

Next, a fifth embodiment of the present invention will be described.

Figure 10:
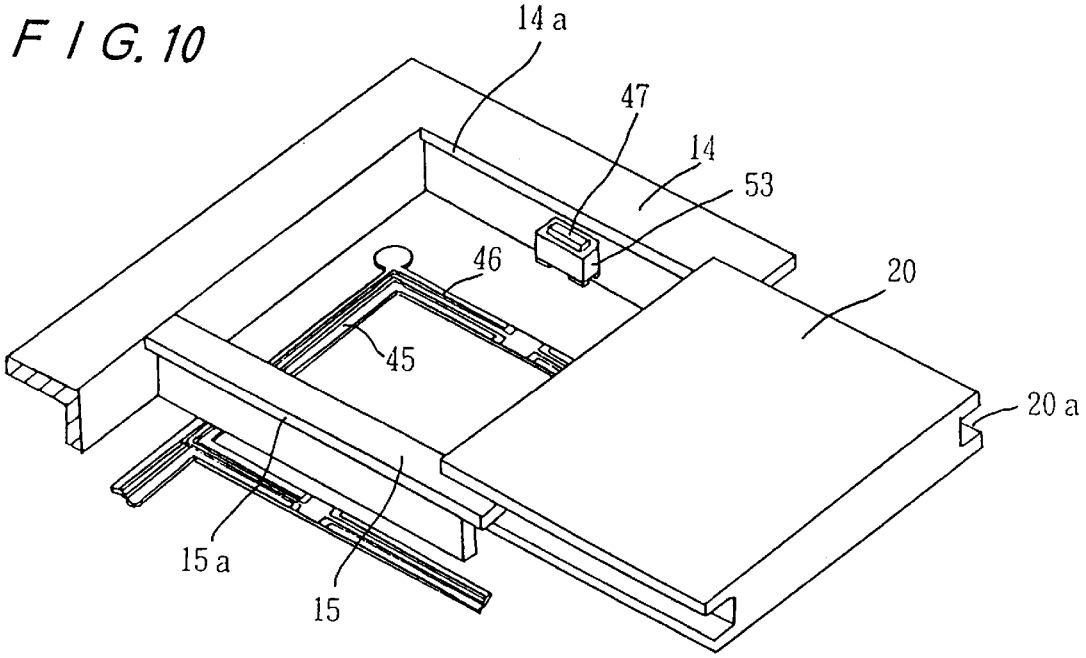
FIG. 10 is an enlarged perspective view of a main portion of a display switch according to a fifth embodiment of the present invention.

FIG. 10 is an enlarged perspective view of a main portion of a display switch according to the fifth embodiment of the present invention. A flexible printed circuit board 45 having circuit patterns 46 is disposed on the top surface of the display. On the flexible printed circuit board 45 is a frame member 14 and partition plates 15 built in the frame member 14. A plurality of buttons 20 are disposed in respective spaces formed by the frame member 14 and the partition plates 15. The buttons 20 are formed of a transparent material in order to allow a user to see images on the display through the buttons 20.

A depression 20*a* is formed in each of at least two opposite side surfaces of each button 20, and the frame member 14 and the partition plates 15 have continuously formed flange portions 14*a* and 15*a*. These flange portions 14*a* and 15*a* are engaged with the depressions 20*a* of the buttons 20 through depression/projection engagement. Although not illustrated in the drawings, the frame member 14 and the partition plates 15 are assembled together through depression/projection engagement. During this assembly, the buttons 20 are slid into the respective spaces between the flange portions 14*a* of the frame member 14 and the flange portions 15*a* of the partition plates 15 and between the flange portions 15*a* of the partition plates 15, so that the depressions 20*a* of the buttons 20 engage with the flange portions 14*a* and 15*a*. Tactile switches 53 of an automatic return type are disposed on the flexible printed circuit board 45 as switch elements 47. In an ordinary state, the tactile switches 53 push the buttons 20 upward.

In the display switch having the above-described structure, when one of the buttons 20 is depressed, the corresponding switch element 47 is depressed, so that the switch element 47 electrically connects the circuit patterns 46 of the flexible printed circuit board 45, so that an electric circuit is closed.

When the depressing pressure acting on the button 20 is removed, the button 20 moves upward in order to return to its original position. In the present embodiment, the switch element 47 serves as a spring for returning the button 20 to its original position.

The flexible printed circuit boards shown in FIG. 8 and FIG. 10 may be a multi-layer type such as a two-layer type or a three-layer type. Various kinds of flexible printed circuit boards may be used depending on the number of the buttons.

Next, a sixth embodiment of the present invention will be described.

Figure 11:
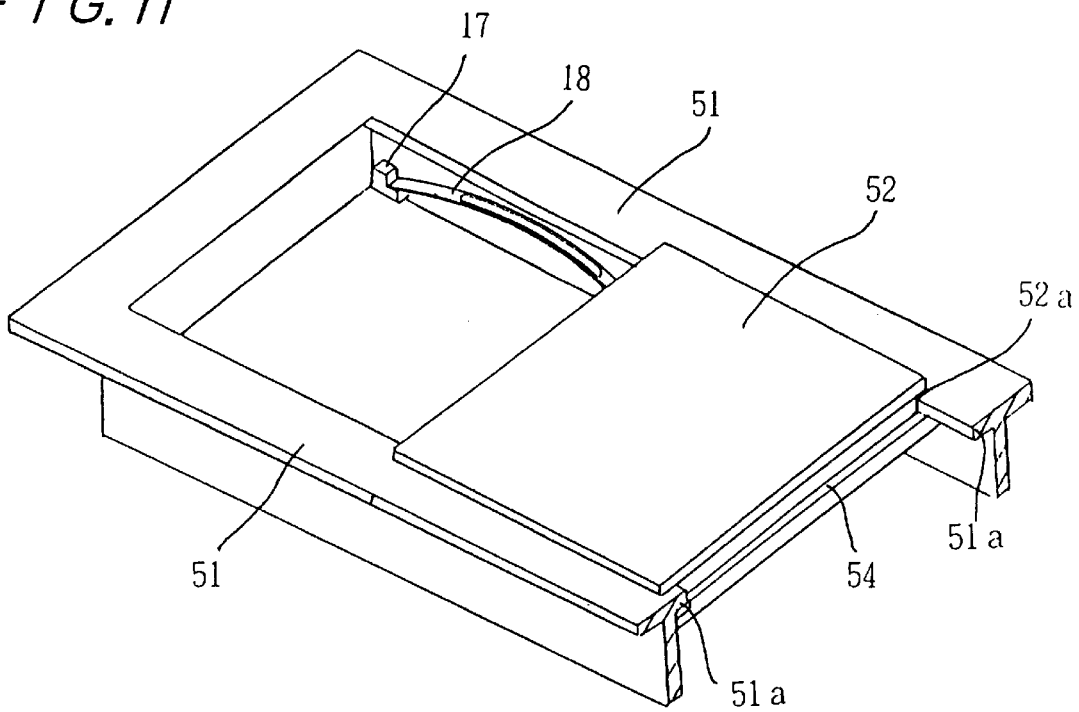
FIG. 11 is an enlarged perspective view of a main portion of a display switch according to a sixth embodiment of the present invention.
Figure 12:
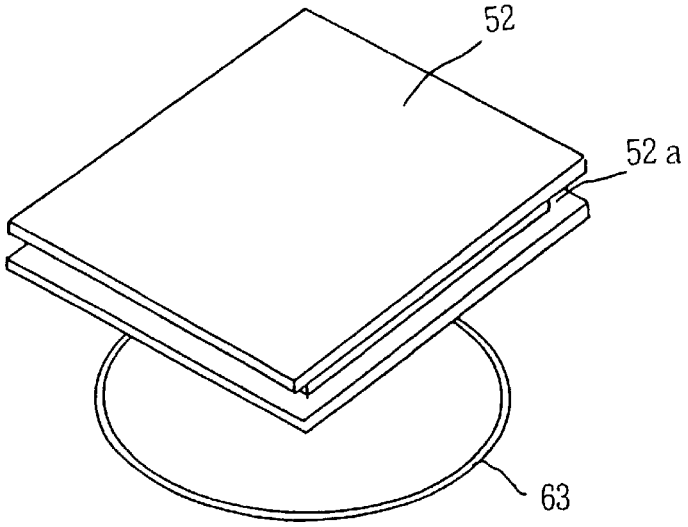
FIG. 12 is an enlarged perspective view showing a button of the display switch according to the sixth embodiment of the present invention.

FIG. 11 is an enlarged perspective view of a main portion of a display switch according to the sixth embodiment of the present invention. The present embodiment is generally the same as the first embodiment. However, in the present embodiment, no partition plates are provided, and a plurality of buttons 52 is disposed in a single row. As shown in FIG. 12, a recess 52*a* is formed in the circumferential surface of the button 52, and an elastic body 54 made of rubber, sponge or a like material is disposed within the recess 52*a*, so that the clearance between the frame member 51 and the button 52 can be decreased considerably. Accordingly, it is possible to prevent invasion of dust. In FIG. 11, numeral 51*a* denotes a flange portion of the frame member 51. In FIG. 12, numeral 63 denotes an O-ring that can be used as an elastic body.

The provision of the elastic body does not make images on the screen of the display unclear, nor does it adversely affect the contact portion. Accordingly, the display switch can be used under a bad environment, and therefore it has a wider range of applications.

Next, a seventh embodiment of the present invention will be described.

Figure 13:
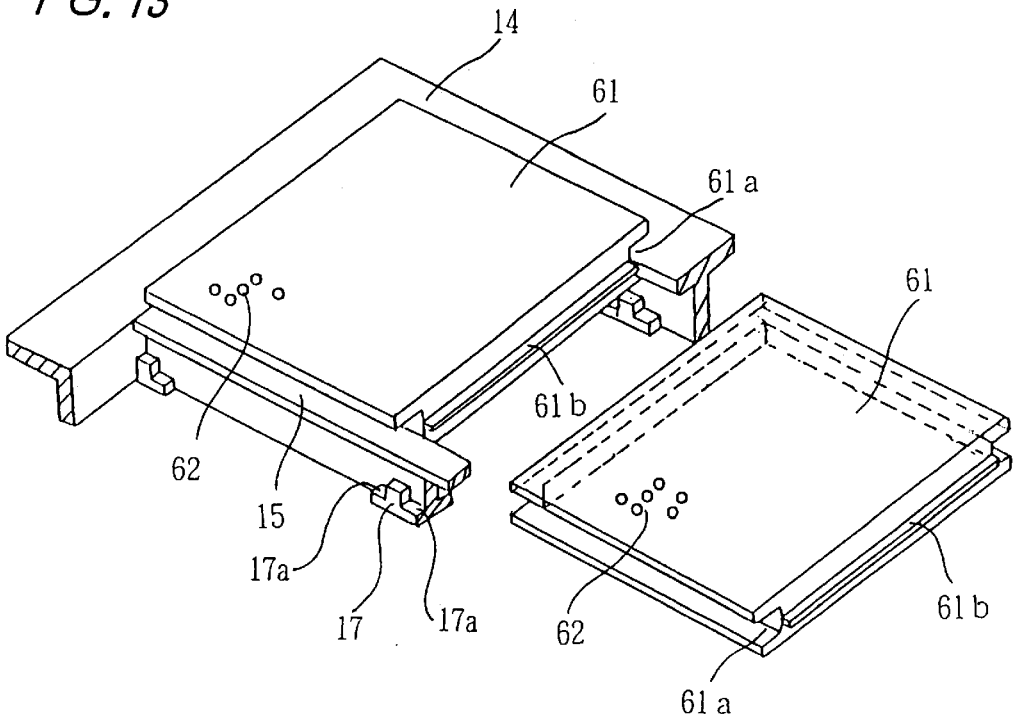
FIG. 13 is an enlarged perspective view of a main portion of a display switch according to a seventh embodiment of the present invention.
Figure 14:
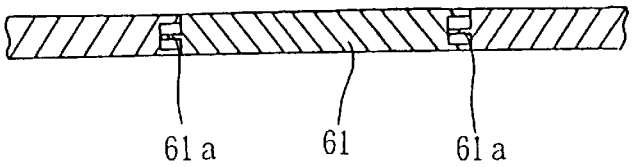
FIG. 14 is an enlarged sectional view of the main portion of the display switch according to the seventh embodiment of the present invention.

FIG. 13 is an enlarged perspective view of a main portion of a display switch according to the seventh embodiment of the present invention; and FIG. 14 is an enlarged sectional view of the main portion of the display switch. One of the side surfaces of adjacent buttons 61 facing each other has a depression 61*a* and the other has a projection 61*b*. The buttons 61 are disposed in the spaces formed by the frame member 14 and the partition plates 15 such that the depression 61*a* engages with the projection 61*b*.

As in the structure shown in FIG. 11, images on the screen of the display do not become unclear, and the contact portion is not adversary affected. Accordingly, the display switch can be used under a bad environment, and therefore it has a wider range of applications.

Also, protrusions that form a Braille character 62 such as 1, 2, 3, etc., may be provided on each button 61 made of a transparent member. It becomes possible to solve the social problem that sight-impaired persons cannot find the position of an operation portion of the switch with their fingers.

Next, an eighth embodiment of the present invention will be described.

Figure 15:
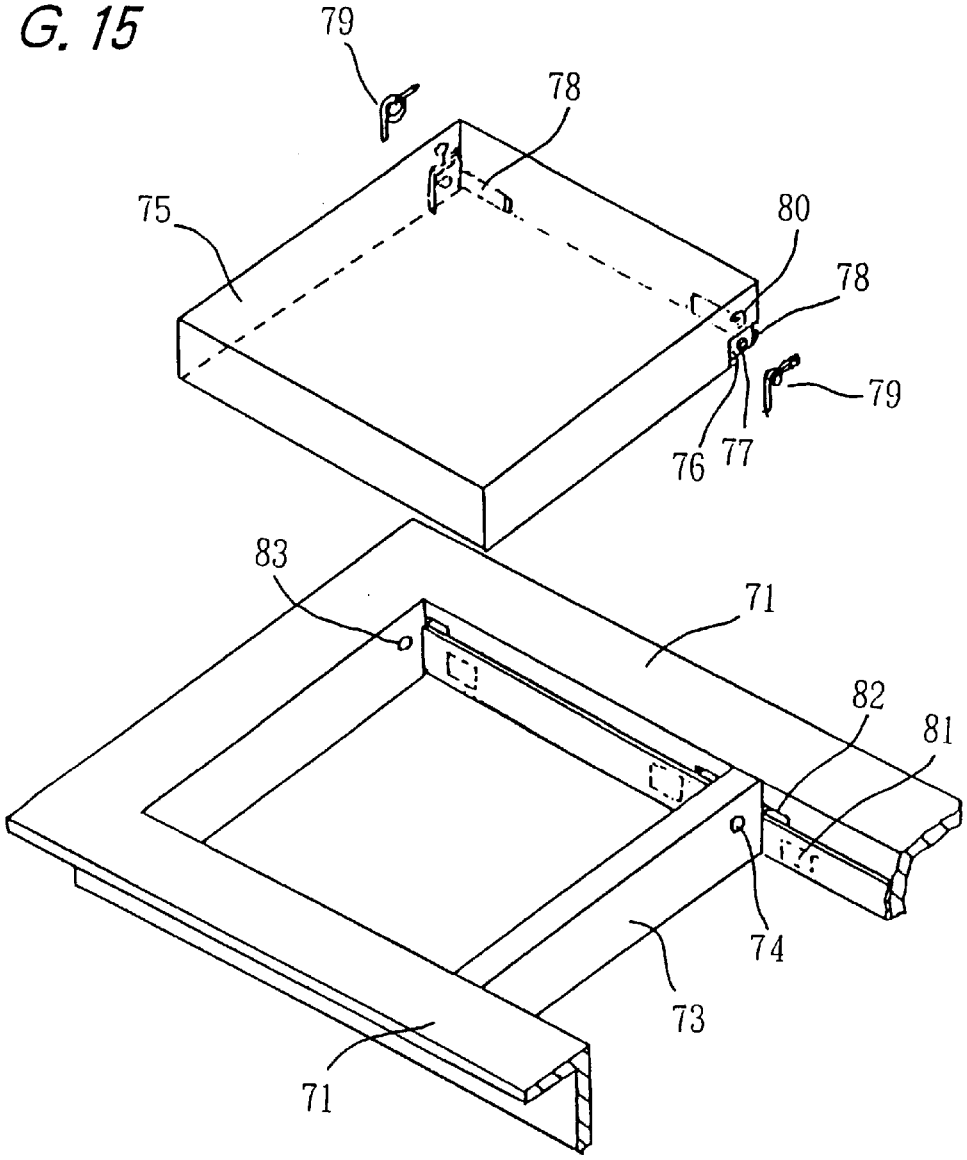
FIG. 15 is an enlarged perspective view of a main portion of a display switch according to an eighth embodiment of the present invention.
Figure 16:
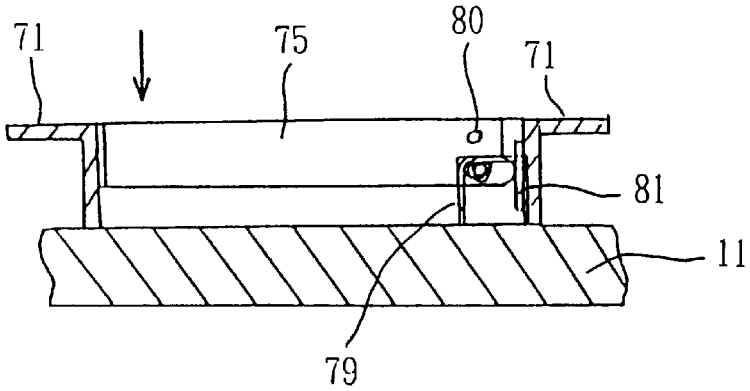
FIG. 16 is an enlarged sectional view of the main portion of the display switch according to the eighth embodiment of the present invention.

FIG. 15 is an enlarged perspective view of a main portion of a display switch according to the eighth embodiment of the present invention; and FIG. 16 is an enlarged sectional view of the main portion of the display switch. In these drawings, numeral 11 denotes a display, such as a CRT or an LCD, which electrically displays characters, symbols, and the like. On the top surface of the display 11 is disposed a frame member 71. A plurality of buttons 75 are disposed on the frame member 71.

Membrane switches 81 serving as switch elements are disposed on the inside surface of the frame member 71. Each of the membrane switches 81 is composed of upper and lower sheets each of which has an electrode and which is separated from each other via a spacer interposed therebetween. The frame member 71 and the partition plate 73 have paired depressions 74 and 83 that face each other. A button 75 is pivoted on the frame member 71 through engagement with the depressions 74 and 83.

That is, a projection 80 is formed on each of two opposite side surfaces of the button 75. The projections 80 of the button 75 are fitted into the depression 83 of the frame member 71 and the depression 74 of the partition plate 73, respectively. Under each projection 80 of the button 75, a depression 76 is formed, and an anchor projection 77 is formed within the depression 76. A twisted spring 79 is disposed to be supported by the anchor projection 77. The both ends of the twisted spring 79 are received by the depression 76 of the button 75 and an anchor recess 82 formed in the side surface of the frame member 71. Also, elevated portions 78 are formed on the side surface of the button 75 which faces the membrane switches 81. When the button 75 tilts about the projections 80, the elevated portions 78 provided on the side surface of the button 75 press the membrane switches 81.

Since only the buttons 75 formed of a transparent material are disposed on the top surface of the display 11, images can be displayed clearly on the display 11 without degradation of quality.

Figure 17:
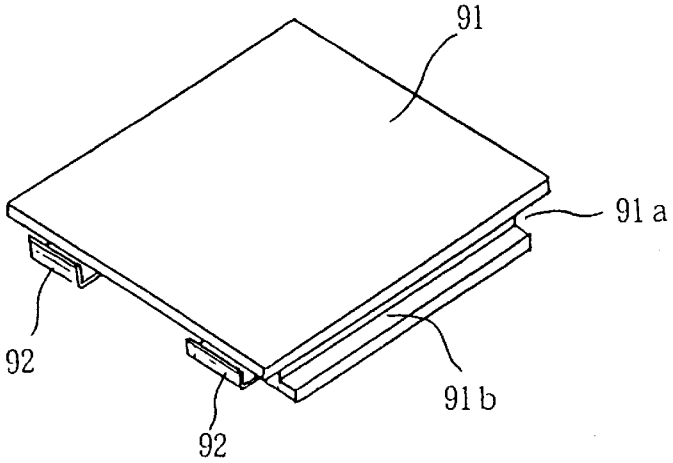
FIG. 17 is an enlarged perspective view of a main portion of a display switch according to another embodiment of the present invention.

FIG. 17 is an enlarged perspective view of a main portion of a display switch according to another embodiment of the present invention. Depressions 91*a* and 91*b* are formed on two opposite side surfaces of a rectangular button 91, and tongue portions 92 are projected form the remaining two side surfaces of the button 91. The button 91 can be engaged with the corresponding flange portion of the frame member (not illustrated) or the partition plate (not illustrated) from the upper side thereof. The O-ring 63 shown in FIG. 12 may be disposed in the depressions 91*a* and 91*b* of the side surfaces of the button 91 and the space between the tongue portions 92 and the side surface of the button 91.

The above-described first through eighth embodiments of the present invention provide the following advantages.

(1) The above-described display switch comprises a frame member disposed on the top surface of a display, switch elements supported by the frame member, and a plurality of buttons formed of a transparent material and disposed within the frame member A depression is formed in each of at least two opposite side surfaces of each button, and the frame member has flange portions that engage with the depressions in order to limit movement of the buttons. Also, there are disposed elastic members for returning the buttons to their original positions. Accordingly, unlike a conventional touch panel switch disposed on a CRT screen, each of the buttons formed of a transparent material moves over a proper stroke, so that the chance of erroneous operation can be decreased, and a secure feel can be imparted to a user upon operation. In addition, a user can have a sense of security during operation.

(2) Since a plurality of buttons made of a transparent material are depressably disposed on the frame and partition plates via the elastic members, the operation position becomes distinct, thus solving the social problem that sight-impaired persons cannot find the position of an operation portion of the switch with their fingers.

In addition, when protrusions that form a Braille character such as 1, 2, 3, etc., are provided on each button, the above-described effect becomes remarkable.

(3) Since the elastic members are disposed on the frame member or partition plates so as to allow the buttons to move within a proper stroke, a user does not press the button with a force greater than the required level, so that the fingertip does not receive excessive force. Accordingly, the display switch can be operated in an improved manner, and is prevented from being broken due to excessive pressing force.

(4) Since the elastic members are disposed on the frame member or partition plates, and the buttons are disposed so as to be supported by the frame and partition plates via the elastic members, the operation surface inevitably becomes sturdy, so that the switch is not broken even when operated violently through use of, for example, a writing instrument or a screw driver instead of a finger. Also, the application of the switch is not limited, and the switch can be applied to many types of displays.

(5) Even when a transparent sheet is disposed between the bottom surface of buttons and the top surface of the underlying display, the numbers of sheets serving as switch elements can be minimized. Accordingly, images on the display can be seen through the switch more clearly as compared to the conventional switch, so that visibility is remarkably high and misidentification and confusion can be avoided.

(6) Since the switch element is composed of a flexible printed circuit board and an elastic member of an electrically conductive material, or is composed of a tactile switch, the switch also serves the function of a spring for returning the button to its original position. Accordingly, the display switch can be made simpler, lighter, thinner, and smaller. Also, assembly of the display switch can be facilitated.

(7) A depression is formed on the outside surface of each button, and an elastic member is disposed in the depression. Alternatively, the facing side surfaces of adjacent buttons are movably engaged with each other through depression/projection engagement. Accordingly, dust is prevented from entering the frame member and from reaching the display screen of the display, so that the display switch is prevented from causing unstable contact, and the display is prevented from becoming unclear.

(8) When the switch element is disposed on the side surface of the frame member, and the button is pivoted on the frame member so as to press the switch element through a side surface thereof, images can be displayed on the display without degradation of quality, because only the buttons formed of a transparent material are disposed on the display.

Next, a ninth embodiment of the present invention will be described.

Figure 18:
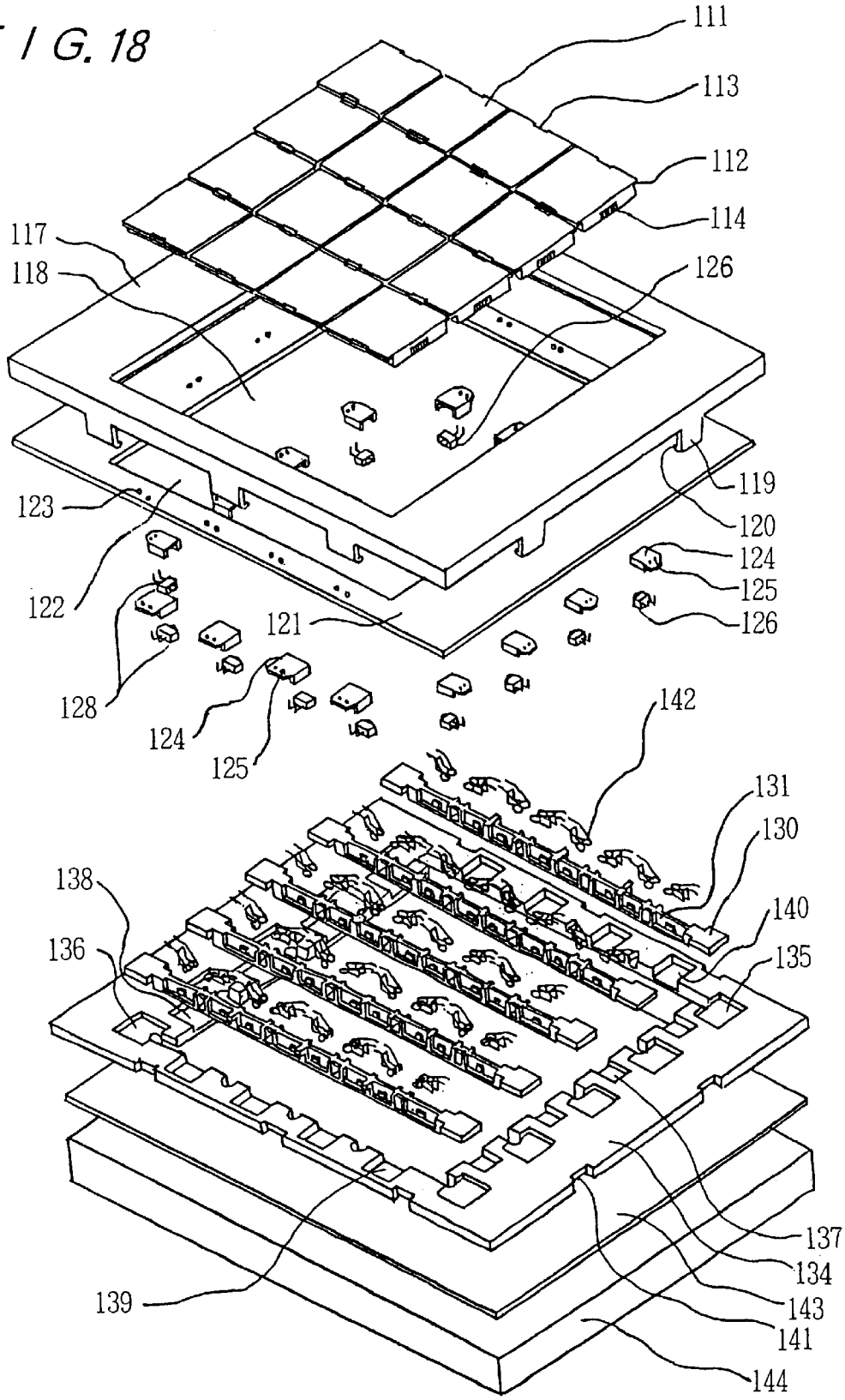
FIG. 18 is an exploded perspective view of a display switch according to a ninth embodiment of the present invention.
Figure 19:
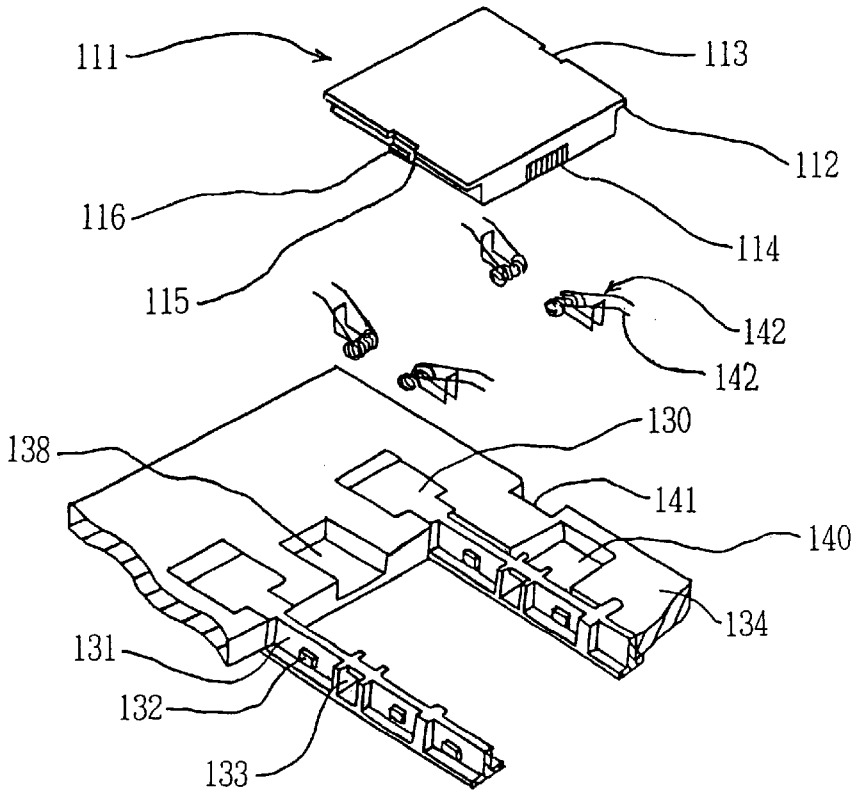
FIG. 19 is a perspective view of a main portion of the display switch according to the ninth embodiment of the present invention.
Figure 20:
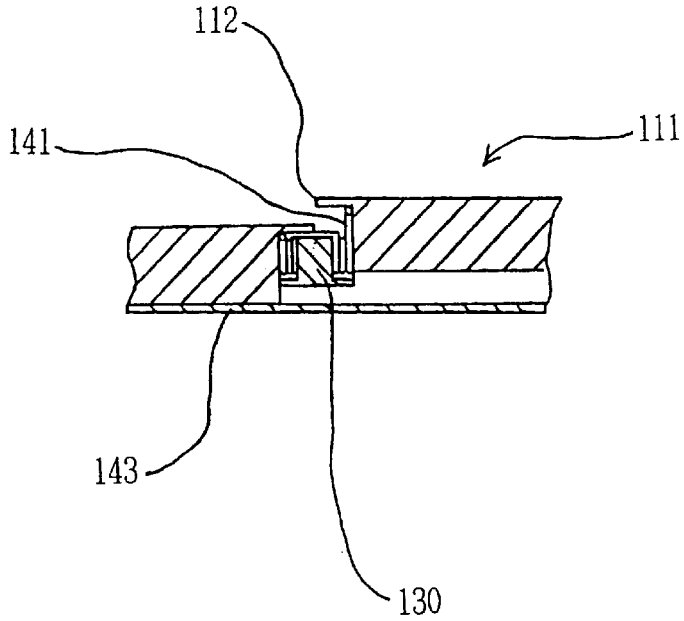
FIG. 20 is a cross-sectional view showing the button return mechanism of the display switch according to the ninth embodiment of the present invention.
Figure 21:
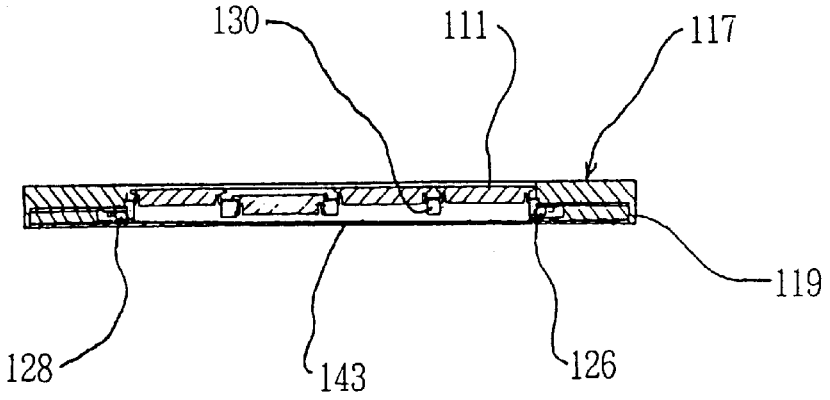
FIG. 21 is a cross-sectional view of the display switch according to the ninth embodiment of the present invention.
Figure 22:
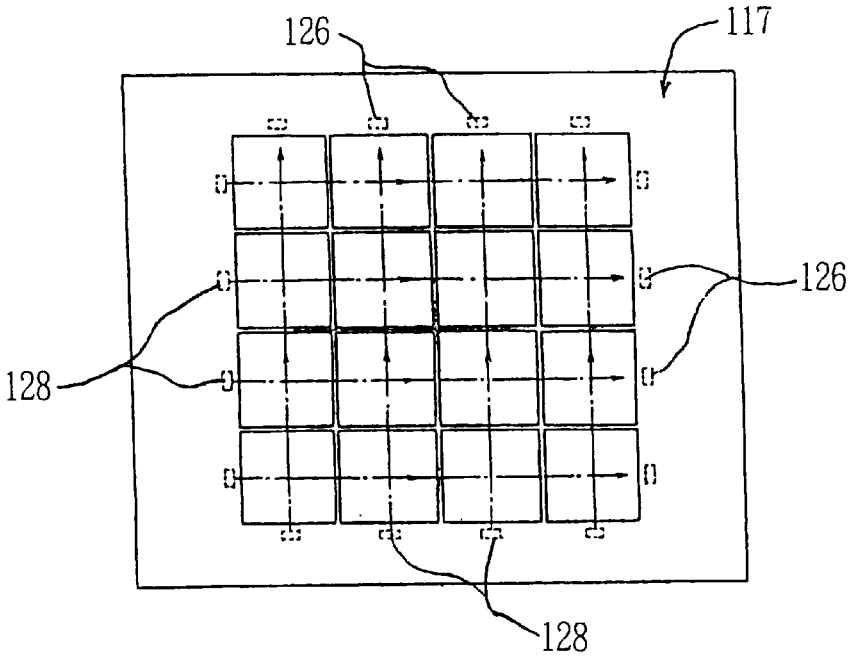
FIG. 22 is a plan view of the display switch according to the ninth embodiment of the present invention.

FIG. 18 is an exploded perspective view of a display switch according to the ninth embodiment of the present invention; FIG. 19 is a perspective view of a main portion of the display switch; FIG. 20 is a cross-sectional view showing the button return mechanism of the display switch; FIG. 21 is a cross-sectional view of the display switch; and FIG. 22 is a plan view of the display switch.

In these drawings, numeral 134 denotes a frame member. In two opposite sides of the frame member 134, a plurality of first recesses 135 and a plurality of second recesses 136 are respectively formed. A plurality of third recesses 137 and a plurality of forth recesses 138 are respectively formed between the recesses 135 and between the recesses 136. In the remaining two sides of the frame member 134, a plurality of fifth recesses 139 and a plurality of sixth recesses 140 are respectively formed. Light receiving elements 126 and light-emitting elements 128 are disposed in the recesses 137, 138, 139 and 140 such that the light receiving elements 126 and the light-emitting elements 128 face each other.

Further, on the side surfaces of the frame member 134 are formed fixation recesses 141, which engage with projections 120 of downwardly extended portions 119 of a decorative plate 117, which will be described later.

The opposite ends of each partition plate 130 are respectively fitted into the first recesses 135 and the second recesses 136 of the frame member 134, so that the inside space of the frame member 134 is divided into a plurality of rows. Through holes 133 are formed in the partition plate 130, and a depression 131 is formed on either side of each through hole 133. Elastic members 142, which will be described later, are disposed in the depressions 131.

In the ninth embodiment of the present invention, the inside space of the frame member 134 is equally divided. However, in order to dispose buttons having a size n times a unit size (n is an integer), the inside space of the frame member 134 may be divided according to the size of the buttons, i.e., according to the application. In the present embodiment, five partition plates 130 each having four through holes 133 are disposed within the frame body 134, so that sixteen buttons 111 are disposed. Numeral 113 denotes a recess of the button 111.

Each of the elastic members 142 disposed on the partition plates 130 is a coil spring whose center portion is bent in a C-like shape and whose free ends 142*a* are symmetrically formed. The spring is attached from the upper side of the partition plate 130 such that the C-shaped portion engages with an anchor projection 132 provided on the partition plate 130. Although not illustrated in the drawings, a groove is formed on the upper surface of the partition plate 130 for positioning of the elastic member 142.

Numeral 121 denotes a printed circuit board having a circuit on its bottom surface. The printed circuit board 121 has a rectangular hole 122 substantially equal to the opening of the frame member 134. Holes 123 for receiving the terminals of the light-receiving elements 126 and the light-emitting elements 128 are formed around the rectangular hole 122. On two adjacent sides of the printed circuit boards 121, the plurality of light-receiving elements 126 are disposed via spacers 124. On the remaining two adjacent sides of the printed circuit board 121, the plurality of light-emitting elements 128 are disposed via spacers 124. Therefore, the light-receiving elements 126 and the light-emitting elements 128 face each other so that light paths are formed in a matrix. Each of the spacers 124 is formed in a C-like shape and has holes 125 into which the terminals of the light-receiving element 126 or the light-emitting element 128 are inserted. The spacer 124 adjusts the position of the corresponding light path formed between the light-receiving element 126 and the light-emitting element 128.

The printed circuit board 121 is disposed on the top surface of the frame member 134, and the decorative plate 117 is disposed on the printed circuit board 121. The decorative plate 117 has a rectangular hole 118 that is substantially equal to the opening of the printed circuit board 121 and a plurality of downwardly extended portions 119 provided on the side surfaces thereof. The projections 120 of the downwardly extended portions 119 are engaged with the fixation recesses 141 of the frame body 134. Further, a base 143 formed of a transparent material is disposed under the frame member 134. Numeral 144 denotes a display.

The buttons 111 formed of a transparent material are disposed between the partition plates 130. Each of the buttons 111 has, on each of the opposite side surface, flange portions 112 and an elastic tongue 115 having a projection 116. Each button 111 is engaged with the corresponding through holes 133 of the corresponding partition plates 130 such that the button 111 is vertically movable. A light shielding portion 114 is provided on each of the four side surfaces of the button 111. The light shielding portion 114 has parallel projections and depressions for reflecting light in order to shut off the corresponding light paths. The light shielding portions 114 may be formed in various methods, such as a method in which black-colored portion is formed through 2-color molding or application of paint, and a method in which separate parts are attached to the button 111.

In the display switch having the above-described structure, when one of button 111 is depressed the lower portion of the button 111 shuts off the corresponding light paths. The position of the depressed button 111 is detected by a separately provided position detector (not illustrated). When the pressing pressure acting on the button 111 is removed the button 111 is returned to its original position by the elastic members 142.

Figure 23:
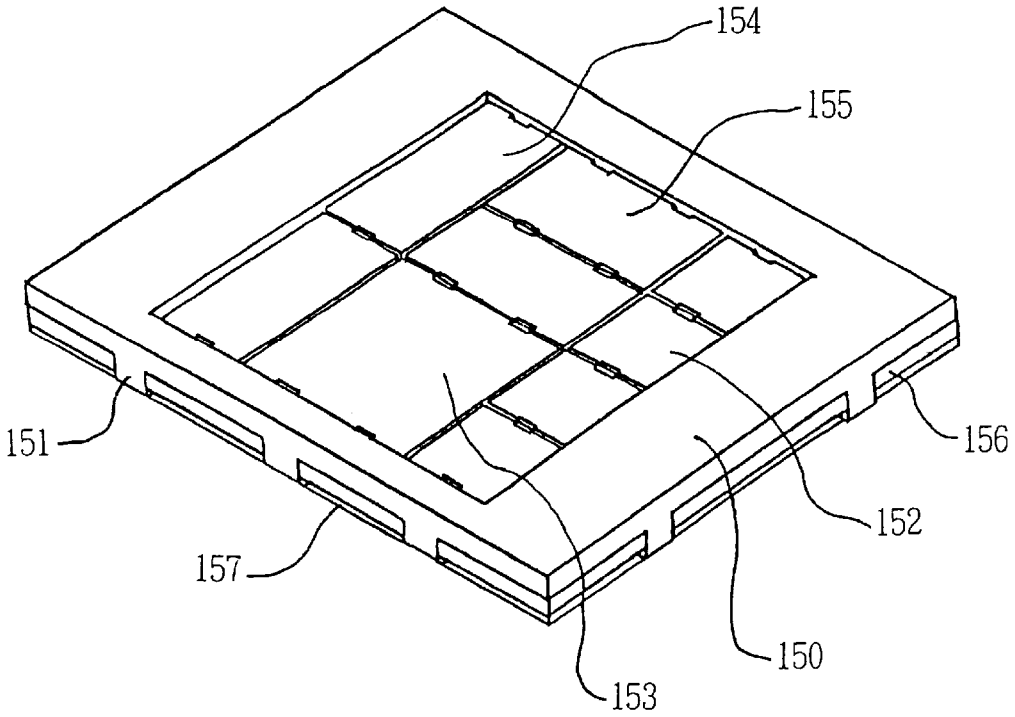
FIG. 23 is a perspective view of a display switch according to a tenth embodiment of the present invention.

FIG. 23 is a perspective view of a display switch according to a tenth embodiment of the present invention. Two partition plates are disposed within the frame member, and buttons 152–155 having various sizes are disposed. The button 153 has longitudinal and lateral lengths twice those of the buttons 152. Each of the buttons 154 has a lateral dimension twice that of the buttons 152. Each of the buttons 155 has a longitudinal length twice that of the buttons 152. Numeral 150 denotes a decorative plates numeral 151 denotes downwardly extended portions, numeral 156 denotes a frame member, and numeral 157 denotes a base.

As described above, buttons having selected sizes can be disposed in accordance with the application of the display switch.

Figure 24:
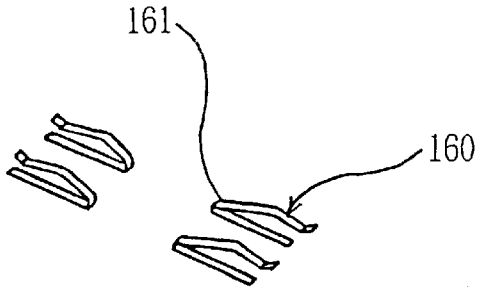
FIG. 24(A) is a perspective view showing an example of an elastic member of the display switch according to the tenth embodiment of the present invention.
FIG. 24(B) is a perspective view showing another example of the elastic member of the display switch according to the tenth embodiment of the present invention.
Figure 24:
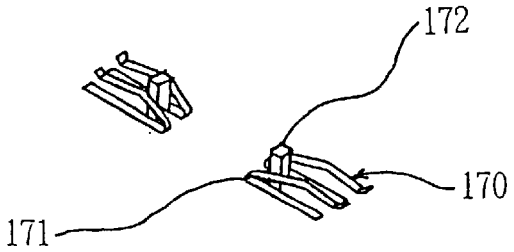

FIG. 24(A) is a perspective view showing an example of an elastic member of the display switch according to the tenth embodiment of the present invention; and FIG. 24(3) is a perspective view showing another example of the elastic member of the display switch.

FIG. 24(A) shows elastic members 160 each having a U-shaped bent portion 161. The elastic members 160 are received by the depressions of the partition plates. FIG. 24(B) shows elastic members 170 each comprising two elastic member elements integrally connected by a C-shaped bent portion 172. Each elastic member element has a U-shaped bent portion 171. Each of the elastic members 170 is disposed such that the corresponding partition plate is pinched by the C-shaped bent portion 172.

The above-described ninth and tenth embodiments of the present invention provide the following advantages.

(1) The display switch comprises a decorative plates a rectangular frame member, and partition plates for dividing the inside space of the frame member into a plurality of rows. A plurality of buttons formed of a transparent material are movably disposed within the frame member, and elastic members are disposed under the buttons so as to push upward the buttons. Moreover, on the bottom surface of a printed circuit board, light-emitting elements are disposed along two adjacent sides while light-receiving elements are disposed along the remaining two sides such that the light-emitting elements are opposed to the light-receiving elements and light paths are formed in a matrix. When one of the buttons is operated the light paths between the light-emitting elements and the light-receiving elements are shut off. Accordingly, unlike a conventional touch panel switch disposed on a CRT screen, each of the buttons formed of a transparent material moves over a proper stroke, so that the chance of erroneous operation can be decreased, and a secure feel can be imparted to a user upon operation. In additions images on the display can be seen clearly, and a user can have a sense of security during operation.

(2) The decorative plate, the rectangular frame member, and the partition plates for dividing the inside space of the frame member into a plurality of rows are provided, and the plurality of buttons formed of a transparent material are depressably engaged with through holes formed in the partition plates through depression/projection engagement. Accordingly, even in the state in which the display switch is attached to a unit or devices the buttons can be removed from and attached to the decorated plate from the upper side thereof, so that the buttons can be removed quite easily for removal of dust that has entered the frame member or for replacement of a button having scratches formed on the surface thereof.

(3) The elastic member is composed of a coil spring having symmetric free ends or a plate spring that is bent sophisticatedly, and the elastic member is engaged with the corresponding partition plates. Accordingly, assembly of the display switch is extremely easy. In addition, when large buttons are used, the operation force can be adjusted through changing the number of the elastic members to be used, so that variation in operation force among various buttons having different sizes can be decreased.

(4) Since light shielding portions are provided on the side surfaces of each button, the resolution of the light paths can be improved even when the buttons are formed of a transparent material.

(5) In order to arrange light paths in a matrix within the frame member, light-emitting elements and light-receiving elements are disposed on the printed circuit board via spacers. The positions of the light paths can be adjusted. Further, the display switch can be made compact and thin.

The present invention is not limited to the above-described embodiments. Numerous modifications and variations of the present invention are possible in light of the spirit of the present invention, and they are not excluded from the scope of the present invention.

What is claimed is:

1. A display switch device comprising:

a display device including a top surface with a display screen and means for electrically changing images displayed on said display screen;

a frame mounted on said top surface and defining an interior space;

switch elements mounted within said frame member;

a plurality of buttons formed of a transparent material and superimposed above respective switch elements;

depressions formed in at least first and second opposing straight side surfaces forming edges of each of said buttons, said depressions extending substantially in parallel with said straight side surfaces; and partitions dividing said interior space into a plurality of rows with adjacent buttons in adjoining rows abutting each other, thereby covering a partition separating said adjoining rows; and flange portions projecting from said frame member and from each of said partitions, said flange portions being engaged with the depressions of said buttons in order to limit movement of said buttons, said depressions and said flanges being sized to allow said abutting.

2. A display switch device according to claim 1, wherein each of said switch elements comprises:

a transparent curved plate formed of an elastic material and corresponding in shape and size to one of said buttons, said curved plate having an electrically conductive bottom surface; and a transparent sheet disposed on said top surface of said display device, said sheet having an electrically conductive upper surface facing said electrically conductive bottom surface.

3. A display switch device according to claim 1, additionally comprising a depression formed in a third straight side surface of each button and a projecting flange portion formed in a fourth straight side surface of each button, opposing said third straight side surface, and wherein adjacent buttons within said plurality of rows are engaged, with allowance for relative movement therebetween, by engagement between the depression of a third straight side edge surface and the projecting flange portion of a fourth straight side edge surface.

4. A display switch device according to claim 1 wherein said depressions are grooves coextensive with said side surfaces and said projecting flange portions on said partitions are ribs coextensive with said partitions.

5. A display switch device comprising:

a display device including a top surface with a display screen and means for electrically changing images displayed on said display screen;

a substantially rectangular frame member mounted on said top surface and defining an interior space;

partitions dividing said interior space into a plurality of rows;

a decorative plate mounted on said frame member, said decorative plate having an upper side defining a perimeter for an exterior surface of the display switch device;

a plurality of buttons formed of a transparent material and mounted for reciprocating movement in said interior space;

elastic members, mounted between said buttons and said top surface, for biasing said buttons toward a rest position;

a printed circuit board mounted between said frame member and said decorative plate, said printed circuit board having four joined side portions defining a central opening;

light-emitting elements disposed on bottom surfaces of two of said side portions of said printed circuit board;

light-receiving elements disposed on bottom surfaces of another two side portions of said printed circuit board, said light-emitting elements being opposed to said light-receiving elements to form a matrix of light paths; and wherein when one of said buttons is operated, corresponding light paths between said light-emitting elements and said light-receiving elements are interrupted and an electric circuit is thereby opened or closed.

6. A display switch device according to claim 5 wherein each of said elastic members is a coil spring having a U-shaped central portion engaged with one of said partitions and two free ends engaged with one of said buttons.

7. A display switch according to claim 5, wherein said buttons are detachably mounted to enable their removal from the upper side of said decorative plate.

8. A display switch device according to claim 5 wherein said depressions are grooves coextensive with said side surfaces and said projecting flange portions on said partitions are ribs coextensive with said partitions.

9. A display switch according to claim 5 wherein said buttons have upper surfaces which, with said buttons in said rest position, are approximately coplanar with said upper side of said decorative plate.

* * * * *

UNITED STATES PATENT AND TRADEMARK OFFICE

CERTIFICATE OF CORRECTION

PATENT NO. : 5,900,599

DATED : May 4, 1999

INVENTOR(S) : OHASHI et al

It is certified that error appears in the above-identified patent and that said Letters Patent is hereby corrected as shown below:

Col. 1, line 9, "strokes" should read --stroke--; and
line 58, after "member" insert a period --.--.

Col. 9, line 47, after "member" insert a period --.--.

Col. 12, line 40, "plates" should read --plate--;
line 49, "24(3)" should read --24(B)--; and
line 65, "plates" should read --plate--.

Col. 13, line 28, "devices" should read --device--.

Signed and Sealed this

Fifth Day of December, 2000

*Attest:*

*Attesting Officer*

Q. TODD DICKINSON

*Director of Patents and Trademarks*